United States Patent [19]

Tomita et al.

[11] Patent Number: 5,037,493

[45] Date of Patent: Aug. 6, 1991

[54] METHOD OF PRODUCING NON-ORIENTED MAGNETIC STEEL PLATE HAVING HIGH MAGNETIC FLUX DENSITY AND UNIFORM MAGNETIC PROPERTIES THROUGH THE THICKNESS DIRECTION

[75] Inventors: Yukio Tomita; Ryota Yamaba, both of Tokai, Japan

[73] Assignee: Nippon Steel Corporation, Tokyo, Japan

[21] Appl. No.: 492,924

[22] Filed: Mar. 13, 1990

[30] Foreign Application Priority Data

| | | | |
|---|---|---|---|
| Mar. 16, 1989 | [JP] | Japan | 1-64732 |
| Mar. 16, 1989 | [JP] | Japan | 1-64733 |
| Mar. 16, 1989 | [JP] | Japan | 1-64734 |
| Mar. 16, 1989 | [JP] | Japan | 1-64735 |
| Mar. 16, 1989 | [JP] | Japan | 1-64736 |

[51] Int. Cl.[5] ..... H01F 1/04

[52] U.S. Cl. ..... 148/111; 148/112; 148/120; 148/121

[58] Field of Search ..... 148/111, 112, 113, 120, 148/121

[56] References Cited

U.S. PATENT DOCUMENTS 4,950,336 8/1990 Tomita et al. ..... 148/111

*Primary Examiner*—John P. Sheehan

*Attorney, Agent, or Firm*—Kenyon & Kenyon

[57] ABSTRACT

A method of producing non-oriented magnetic steel plate that comprises hot-rolling high-purity steel and adjusting the grain size together with the dehydrogenation treatment to produce a uniform ferrite grain diameter and impart uniform magnetic properties in a low magnetic field through the thickness direction.

15 Claims, 4 Drawing Sheets

METHOD OF PRODUCING NON-ORIENTED MAGNETIC STEEL PLATE HAVING HIGH MAGNETIC FLUX DENSITY AND UNIFORM MAGNETIC PROPERTIES THROUGH THE THICKNESS DIRECTION

BACKGROUND OF THE INVENTION

1. Field of the Invention

The present invention relates to a method of producing non-oriented magnetic steel plate having high magnetic flux density and uniform magnetic properties through the thickness direction.

2. Description of the Prior Art

With the progress in recent years of elementary particle research and medical instruments, there is a need to improve the performance of devices utilizing magnets which are being used in large structures. There is also a need for materials which exhibit a high magnetic flux density in a low magnetic field to use as magnets in direct current applications and as shielding against magnetic fields. The further increase in the size of structures has also brought a demand for steel in which the magnetic properties have a low variation, and especially for steel plate having uniform magnetic properties through the thickness direction.

Numerous electrical steel sheets having good magnetic flux density have been provided, especially silicon steel sheet and electrical mild steel sheet. However, with respect to their use as structural members, problems with the assembly fabrication and strength of such materials has made it necessary to use steel plate. Among the electrical steel plate which has been produced so far is that using pure iron components, as in JP-B No. 60(1985)-96749.

However, the increasing size and performance of the devices concerned has brought with it a strong demand for steel materials with better magnetic properties, especially a high magnetic flux density in a low magnetic field of, for instance, 80 A/m. With the known steel materials it is not possible to obtain stably a high magnetic flux density in a low magnetic field of 80 A/m. In addition, the practical problem of variation in the magnetic properties of the steel is not addressed, particularly with respect to the uniformity of the magnetic properties through the thickness of the steel.

In U.S. patent application Ser. No. 07/368,031 now U.S. Pat. No. 4,950,336 (EPO Ser. No. 89111463.9) the present inventors proposed a method of producing non-oriented magnetic steel plate having a high magnetic flux density.

SUMMARY OF THE INVENTION

An object of the present invention is to provide a method of producing non-oriented magnetic steel plate having a high magnetic flux density in a low magnetic field and uniform magnetic properties through the thickness direction.

Another object of the present invention is to provide a method of producing non-oriented magnetic steel plate having a high specific resistance, a high magnetic flux density in a low magnetic field and uniform magnetic properties through the thickness direction.

Another object of the present invention is to provide a method of producing non-oriented magnetic steel plate having a low coercive force, a high magnetic flux density in a low magnetic field and uniform magnetic properties through the thickness direction.

Another object of the present invention is to provide a method of producing non-oriented magnetic steel plate having a tensile strength of 40 kgf/mm$^2$ or more, a high magnetic flux density in a low magnetic field and uniform magnetic properties through the thickness direction.

Another object of the present invention is to provide a method of producing non-oriented magnetic steel plate having good machinability, a high magnetic flux density in a low magnetic field and uniform magnetic properties through the thickness direction.

BRIEF DESCRIPTION OF THE DRAWINGS

The objects and features of the present invention will become more apparent from a consideration of the following detailed description taken in conjunction with the accompanying drawings in which.

DETAILED DESCRIPTION OF THE INVENTION

The process of magnetization to raise the magnetic flux density in a low magnetic field consists of placing degaussed steel in a magnetic field and changing the orientation of the magnetic domains by increasing the intensity of the magnetic field so that domains oriented substantially in the direction of the magnetic field become preponderant, encroaching on, and amalgamating with, other domains. That is to say, the domain walls are moved. When the magnetic field is further intensified and the moving of the domain walls is completed, the magnetic orientation of all the domains is changed. In this magnetization process, the ease with which the domain walls can be moved decides the magnetic flux density in a low magnetic field. That is, to obtain a high magnetic flux density in a low magnetic field, obstacles to the movement of the domain wall must be reduced as far as possible.

In this respect, an important technique in the prior art has been to coarsen the size of the grains that form an obstacle to the movement of domain walls (see JP-A60-96749). The inventors found that relying simply on grain coarsening made it difficult to achieve steel plate having a high magnetic flux density in a low magnetic field and, in particular, uniform magnetic properties through the thickness direction, the difficulty being caused by the mix of grain sizes resulting from non-uniformities in stress distribution and temperature distribution occurring during the rolling process. To solve this problem the inventors perfected a production method in which the grain size for uniformity through the thickness direction is made slightly coarse (grain size numbers 1 to 4) and this grain size is made uniform throughout the thickness direction.

Experiments showed that heating the plate at a relatively low temperature oriented the heated $\tau$ grains through the thickness direction, and the addition of light rolling at 800° C. promoted grain growth. The result was that slightly coarse grains were obtained with a uniform size through the thickness direction. The crystalline texture introduced by the light rolling at or below 800° C. orients the domains and facilitates the movement of domain walls, improving the magnetic properties.

Figure 1:
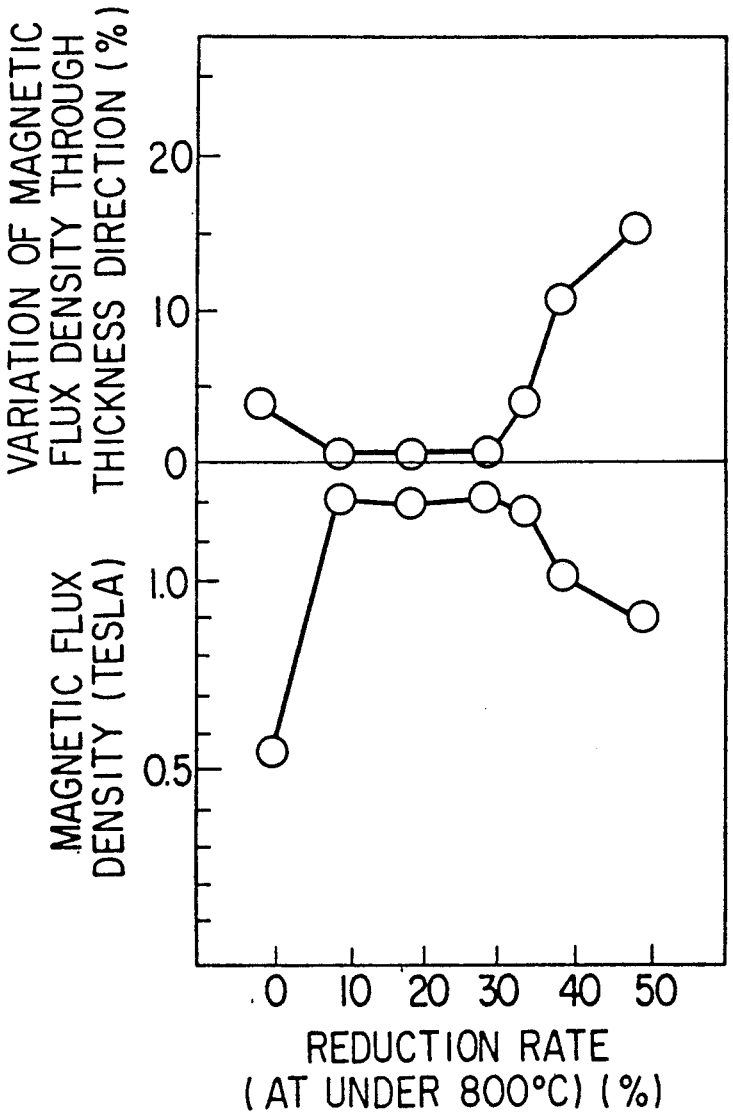
FIG. 1 is a graph showing the relationship between the reduction ratio at 800° C. or below and, respectively, magnetic flux density at 80 A/m and variation of magnetic flux density through the thickness direction.

FIG. 1 shows the relationship between (0.005 Si - 0.06 Mn - 0.015 Al) steel subjected to rolling at 800° C. or below, magnetic flux density at 80 A/m and variation of magnetic flux density through the thickness direction. The heating temperature was 1050° C.

A reduction ratio of 10 - % provided high magnetic flux density and uniform magnetic flux density through the thickness direction of the steel plate.

Detailed investigations carried out by the inventors relating to elements that cause internal stresses and the mechanism of cavity defects enabled them to achieve high magnetic flux density in a low magnetic field.

As AlN prevents the movement of domain walls it should be reduced, preferably by reducing nitrogen and aluminum, especially non-soluble aluminum (to Al <0.005%).

Figure 2:
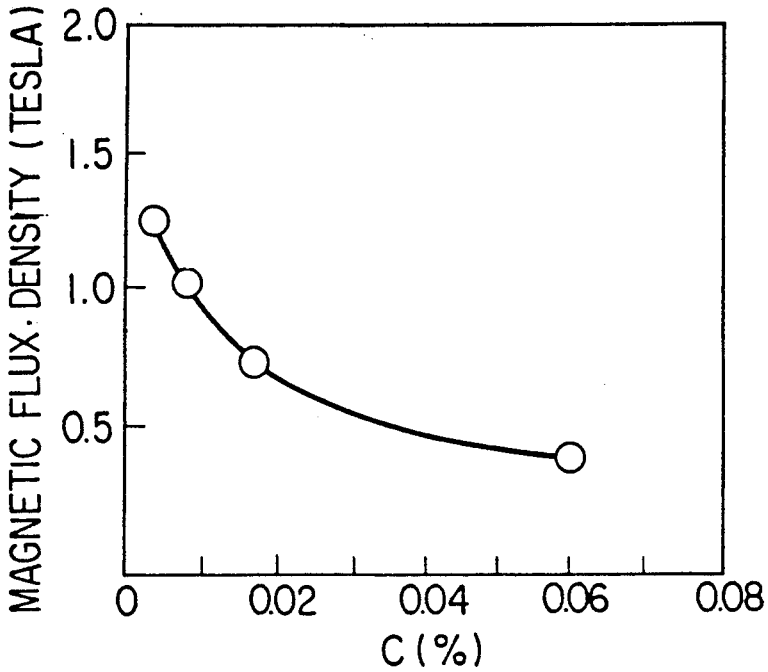
FIG. 2 is a graph showing the relationship between carbon content and magnetic flux density at 80 A/m.

Carbon has to be reduced to reduce internal stresses. FIG. 2 shows that as the carbon content is increased, magnetic flux density in a low magnetic field of 80 A/m goes down. For the samples, (0.01 Si - 0.1 Mn - 0.01 Al) steel was used.

With respect to the effect of cavity defects, it was found that there was a large degradation in the magnetic properties when cavity defects measured 100 micrometers or more. It was also found that a rolling shape factor A of 0.6 or more is required to eliminate such harmful cavity defects measuring 100 micrometers or more.

This is provided that:

$$A = (2\sqrt{R(h_1 - h_0)})/(h_1 + h_0)$$

where

A: rolling shape factor $h_1$: entry-side plate thickness (mm)

$h_0$: exit-side plate thickness (mm)

R: radius (mm) of rolling roll.

Figure 3:
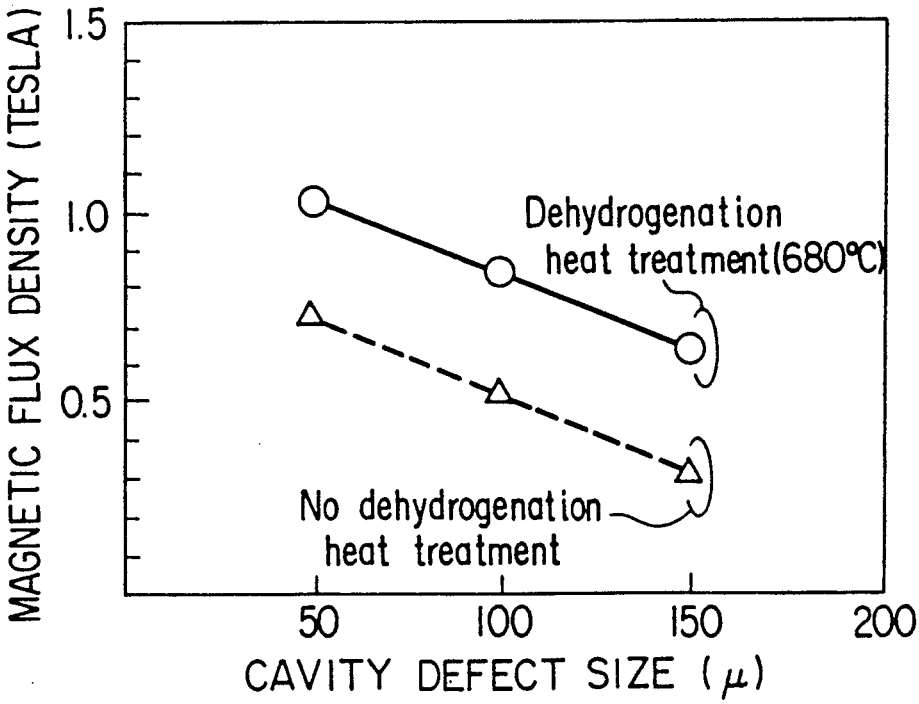
FIG. 3 is a graph showing the relationship between cavity defect size and dehydrogenation heat treatment temperature on magnetic flux density at 80 A/m.

As shown by FIG. 3, the presence of hydrogen in the steel is deleterious, and it was discovered that the magnetic properties could be improved greatly by the use of dehydrogenation heat treatment.

FIG. 3 shows that by using high shape factor rolling to reduce the size of cavity defects to less than 100 micrometers and reducing the hydrogen content in the steel by dehydrogenation heat treatment, magnetic flux density in a low magnetic field could be markedly raised. For the samples, (0.007 C - 0.01 Si - 0.1 Mn) steel was used.

Thus, the present invention comprises the steps of:

preparing a steel slab comprising, by weight, up to 0.01 percent carbon, up to 0.20 percent manganese, up to 0.20 percent phosphorus, up to 0.010 percent sulfur, up to 0.05 percent chromium, up to 0.01 percent molybdenum, up to 0.01 percent copper, up to 2.0 percent nickel, up to 0.20 percent titanium, up to 0.004 percent nitrogen, up to 0.005 percent oxygen and up to 0.0002 percent hydrogen, and one or more deoxidizing agents selected from a group consisting of up to 4.0 percent silicon, 0.005 to 0.40 percent aluminum, and 0.0005 to 0.01 percent calcium, with the remainder being substantially iron;

heating the slab to a temperature of 950° to 1150° C;

carrying out at least one hot-rolling at a rolling shape factor A of at least 0.6 at a finish rolling temperature of at least 800° C;

following this by hot rolling at a temperature of up to 800° C. and a reduction ratio of 10 to 35 percent;

applying dehydrogenation heat treatment at between 600° and 750° C. for steel plate with a gage thickness of 50 mm or more;

annealing at a temperature of 750° to 950° C. or normalizing at a temperature of 910° to 1000° C., as required;

annealing at a temperature of 750° to 950° C. or normalizing at a temperature of 910° to 1000° C. for hotrolled steel plate having a gage thickness that is less than 50 mm.

The hot rolling is accomplished using a rolling mill having a radius R (mm) and wherein the steel plate has an entry-side thickness $h_1$ (mm) and an exit-side plate thickness $h_0$ (mm) which exhibits a relationship with rolling shape factor A of the hot rolling as follows:

$$A = (2\sqrt{R(h_1 - h_0)})/(h_1 + h_0).$$

In this invention, preferably the steel is high purity steel comprised of up to 0.01 percent carbon, up to 0.02 percent silicon, up to 0.20 percent manganese, up to 0.010 percent sulfur, up to 0.05 percent chromium, up to 0.01 percent molybdenum, up to 0.01 percent copper, up to 0.004 percent nitrogen, up to 0.005 percent oxygen and up to 0.0002 percent hydrogen and a deoxidizing agent selected from 0.005 to 0.40 percent aluminum and 0.0005 to 0.01 percent calcium, with the remainder being substantially iron.

The reasons for the component limitations in the high-purity steel referred to with respect to the present invention will now be explained.

Carbon increases internal stresses in steel and is the element most responsible for degradation of magnetic properties, especially magnetic flux density in a low magnetic field, and as such, minimizing the carbon content helps to prevent a drop in the magnetic flux density in a low magnetic field. Also, lowering the carbon content decreases the magnetic aging of the steel, and thereby extends the length of time the steel retains its good magnetic properties. Hence, carbon is limited to a maximum of 0.010 percent. As shown in FIG. 2, an even higher magnetic flux density can be obtained by reducing the carbon content to 0.005 percent or less.

Low silicon and manganese are desirable for achieving high magnetic flux density in a low magnetic field; low manganese is also desirable for reducing MnS inclusions. Therefore up to 0.02 percent is specified as the limit for silicon and up to 0.20 percent for manganese. To reduce MnS inclusions, a manganese content of no more than 0.10 percent is preferable.

Sulfur and oxygen produce non-metallic inclusions in the steel and obstruct the movement of magnetic domain walls. The higher the content amounts of these elements, the more pronounced is the deterioration in the magnetic flux density. Therefore, an upper limit of 0.010 percent has been specified for sulfur and 0.005 percent for oxygen.

Because of the adverse affect chromium, molybdenum and copper have on magnetic flux density in a low magnetic field, preferably the content amounts of these elements are kept as low as possible, while another reason for minimizing these elements is to reduce the degree of segregation. Accordingly, an upper limit of 0.05 percent has been specified for chromium, 0.01 percent for molybdenum and 0.01 percent for copper.

Aluminum and calcium are used as deoxidizing agents. For this, a minimum of 0.005 percent aluminum is required. As excessive aluminum will give rise to inclusions, degrading the quality of the steel, an upper limit of 0.040 percent is specified. More preferably, the amount of aluminum should not exceed 0.020 percent in order to reduce the AlN which prevents the movement of domain walls. When $Al<0.005$ percent, instead of aluminum calcium can be used as the deoxidizing agent. For this at least 0.0005 percent calcium is added, while an upper limit of 0.01 percent is specified as more will degrade the magnetic flux density in a low magnetic field.

As nitrogen increases internal stresses in the steel and in the form of AlN has the effect of refining the size of the grains, thereby causing a deterioration in magnetic flux density in a low magnetic field, an upper limit of 0.004 percent has been specified.

To prevent hydrogen having an adverse effect on magnetic properties and preventing reductions in cavity defects, an upper limit of 0.0002 percent hydrogen has been specified.

The method for producing the steel will now be described. The steel is heated to a temperature of 1150° C. prior to rolling. The reason for specifying an upper limit of 1150° C. is that exceeding that temperature will produce a large degree of size variation among the heated $\tau$ grains through the thickness direction which will remain after completion of the rolling, producing non-uniformity of the grains. A heating temperature below 950° C. will increase the resistance to rolling deformation, and hence the rolling load used to achieve a high rolling shape factor for eliminating cavity defects, as described below.

Regarding the hot rolling, the solidification process will always gives rise to cavity defects, although the size of the defects may vary. Rolling has to be used to eliminate such cavity defects, so hot rolling has an important role. An effective means is to increase the amount of deformation per hot rolling, so that the deformation extends to the core of the steel plate.

Employing high shape factor rolling which includes at least one pass at a rolling shape factor A of at least 0.6 so that the size of cavity defects is no larger than 100 micrometers is conducive to obtaining desirable magnetic properties. Eliminating cavity defects in the rolling process by using this high shape factor rolling markedly enhances dehydrogenation efficiency in the subsequent dehydrogenation heat treatment.

Following this by rolling at a temperature of up to 800° C. is conducive to achieving uniform grain growth through the thickness direction, and the resulting crystalline texture produces an alignment of the domains which facilitates the movement of the domain walls in a low magnetic field and improves the uniformity of the magnetic properties through the thickness direction. As shown in FIG. 1, a reduction ratio of at least 10 percent at 800° C. is required to achieve an increase in the magnetic flux density in a low magnetic field. A reduction ratio of 35 percent at up to 800° C. is specified as the upper limit as a reduction ratio over 35 percent will cause a large increase in the variation of the magnetic properties through the thickness direction.

After the hot rolling, dehydrogenation heat treatment is employed on steel plate with a gage thickness of 50 mm or more to coarsen the size of the grains and remove internal stresses. Hydrogen does not readily disperse in steel plate having a thickness of 50 mm or more, which causes cavity defects and, together with the effect of the hydrogen itself, degrades magnetic flux density in a low magnetic field.

For this reason dehydrogenation heat treatment is employed. However, if the temperature of the dehydrogenation heat treatment is below 600° C. the dehydrogenation efficiency is poor, while if the temperature exceeds 750° C. there is a partial onset of transformation. Therefore, a temperature range of 600° to 750° C. is specified. After various studies relating to dehydrogenation time, a time of $[0.6(t-50)+6]$was found to be suitable (here, t stands for the thickness of the plate).

The steel is annealed to coarsen the size of the grains and remove internal stresses. A temperature below 750° C. will not produce a coarsening of the grains, while if the temperature exceeds 950° C., uniformity of the grains through the thickness direction of the steel plate cannot be maintained. Therefore an annealing temperature range of 750° to 950° C. has been specified.

Normalizing is carried out to adjust the grains through the thickness direction of the steel plate and to remove internal stresses. However, with an $Ac_3$ point temperature of below 910° C. or over 1000° C., uniformity of the grains through the thickness direction of the steel plate cannot be maintained, so a range of 910° to 1000° C. has been specified for the normalizing temperature.

The dehydrogenation heat treatment employed for steel plate having a gage thickness of 50 mm or more can also be used for the annealing or normalizing. As hydrogen readily disperses in steel plate that is less than 50 mm thick, such plate only requires annealing or normalizing, not dehydrogenation heat treatment.

Figure 4:
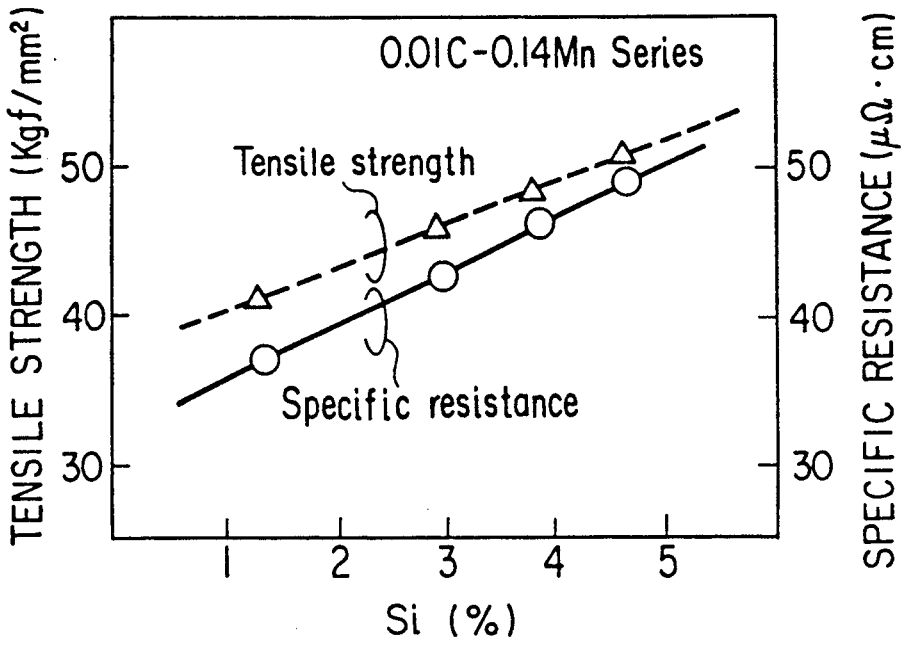
FIG. 4 is a graph showing the relationship between silicon content and tensile strength and specific resistance.

Silicon will now be discussed with respect to another example of the present invention. As shown in FIG. 4, silicon is necessary for imparting to the steel a high specific resistance and a high tensile strength. A range of 1.0 to 4.0 percent is specified as the amount of silicon to be added, because over 4.0 percent will reduce the magnetic flux density in a low magnetic field. Whether aluminum is added or there is no aluminum (i.e., $Al<0.005\%$), adding silicon deoxygenates the steel and helps to raise the specific resistance and tensile strength of the steel. The steel is deoxygenated by the addition of silicon together with either aluminum or calcium in a specified amount.

Figure 5:
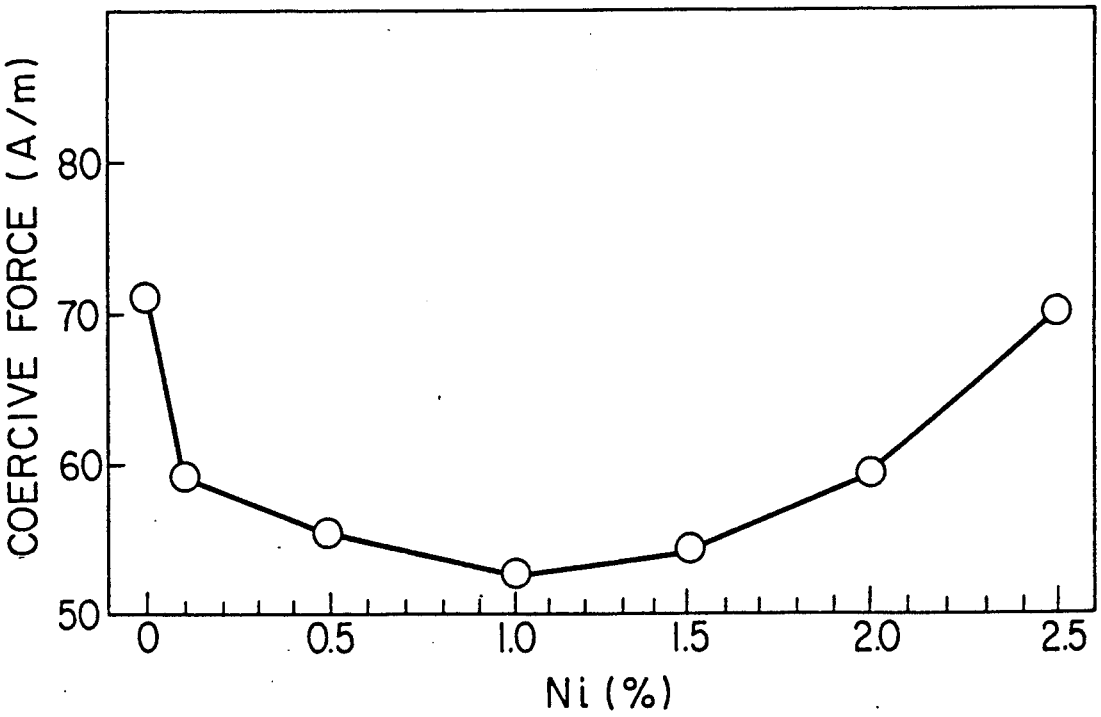
FIG. 5 is a graph showing the relationship between nickel content and coercive force.

Nickel is an effective element for reducing coercive force without reducing magnetic flux density in a low magnetic field. At least 0.1 percent nickel is required to reduce the coercive force. A content of more than 2.0 percent nickel produces an increase in the coercive force and reduces the magnetic flux density in a low magnetic field, therefore a range of 0.1 to 2.0 percent has been specified. This range is also desirable as it enables the strength of the steel to be increased without reducing its magnetic properties. FIG. 5 shows that nickel has an optimum effect with (0.008 C - 0.15 Mn - 0.010 Al) steel.

Figure 6:
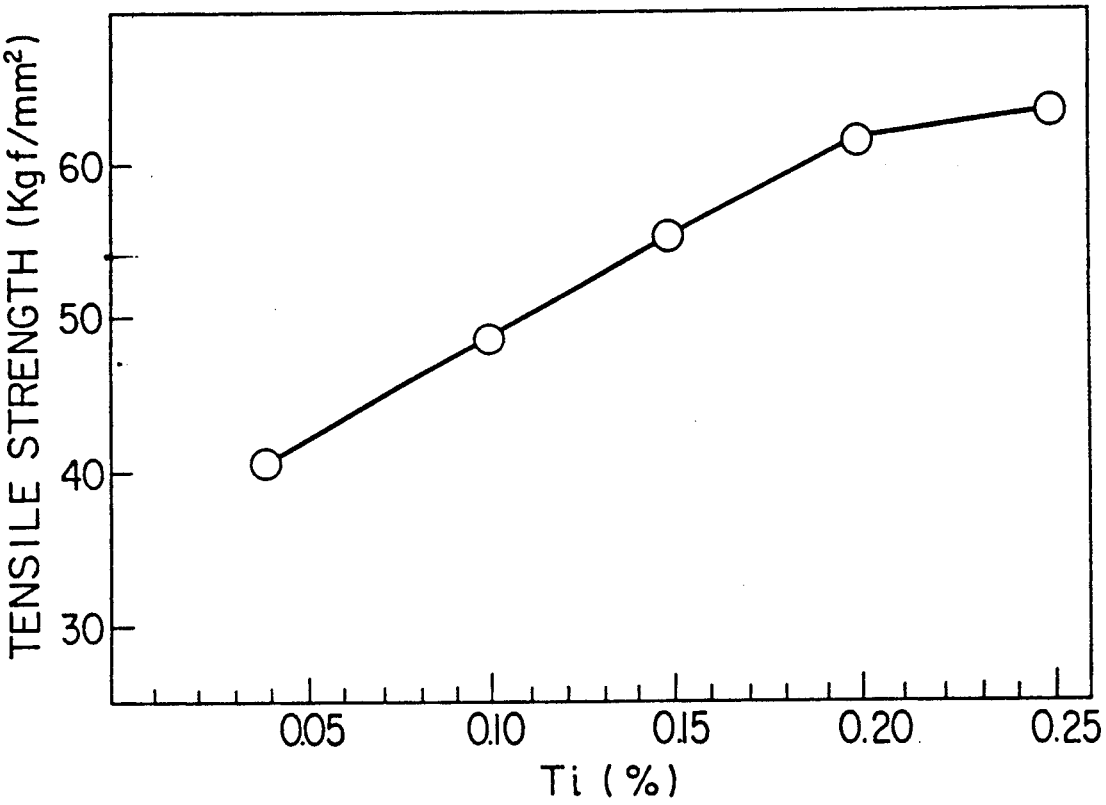
FIG. 6 is a graph showing the relationship between titanium content and tensile strength.

In this invention titanium may also be added. Using titanium as a deoxidizing agent where there is no added aluminum increases the tensile strength of the steel to 40 kgf/mm$^2$ or more without decrease of the magnetic flux density in a low magnetic field. FIG. 6 shows that titanium has an optimum effect with (0.007 C - 0.10 Mn - 0.015 Al) steel. Using titanium as a deoxidizing agent and to achieve a tensile strength of 40 kgf/mm$^2$ or more requires an added amount of at least 0.04 percent. However, as the magnetic flux density in a low magnetic field will be reduced if there is more than 0.20 percent titanium, a range of 0.04 to 0.20 percent is specified.

Figure 7:
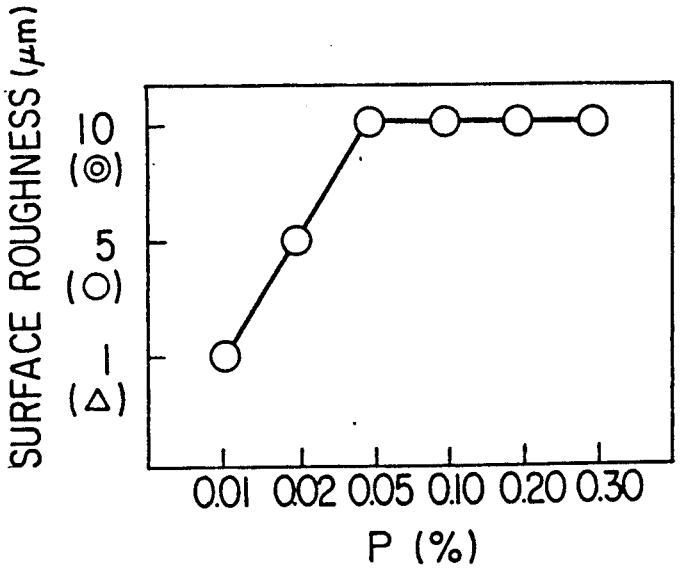
FIG. 7 is a graph showing the relationship between phosphorus content and machinability.

Adding phosphorus is highly effective for improving machinability, especially for reducing surface roughness following machining. Machinability is shown in FIG. 7. With reference to FIG. 7, a 10-meter length of (0.006 C - 0.09 Mn - 0.20 Al) steel was machined. A surface roughness in the order of 10 micrometers is defined as normal (indicated by Δ), a roughness in the order of 5 micrometers is defined as good (indicated by ○), and a roughness in the order of 1 micrometer is defined as good (indicated by ◎). A 12-mm end mill (double cutter) was used.

It can be seen from the figure that adding at least 0.02 percent phosphorus produced a good machinability with a surface roughness not exceeding 5 micrometers. While phosphorus reduces tool wear and improves machinability when at least 0.02 percent is added, as shown by FIG. 7. An upper limit of 0.20 percent is specified as adding more than that reduces magnetic flux density in a low magnetic field.

EXAMPLE 1

Table 1 lists the production conditions, ferrite grain size, magnetic flux density in a low magnetic field and variation of the magnetic flux density through the thickness direction of high-purity electrical steel plate. Steels 1 to 11 are inventive steels and steels 12 to 31 are comparative steels.

Steels 1 to 6, which were finished to a thickness of 100 mm, exhibited high magnetic flux density and low variation through the thickness direction. Compared with steel 1, steel 2, with lower carbon, steels 3 and 4, with lower manganese, steel 5, with lower aluminum, and steel 6, with added calcium and no added aluminum, showed better magnetic properties. Steels 7 to 9, which were finished to a thickness of 500 mm, steel 10, which were finished to a thickness of 40 mm, and steel 11, which was finished to a thickness of 6 mm, each exhibited high magnetic flux density with low variation through the thickness direction.

As a result of the upper limit being exceeded for carbon in steel 12, silicon in steel 13, manganese in steel 14, sulfur in steel 15, chromium in steel 16, molybdenum in steel 7, copper in steel 18, aluminum in steel 19, nitrogen in steel 20, oxygen in steel 21 and hydrogen in steel 22, each of these steels exhibited poorer magnetic properties. Steel 23 showed a large variation of magnetic flux density through the thickness direction owing to the upper limit being exceeded for the heating temperature. Steel 24 also showed a large variation through the thickness direction owing to the heating temperature being below the lower limit, producing a maximum shape factor that was too low, hence a low magnetic flux density. Steel 25 showed a low magnetic flux density resulting from the reduction ratio at 800° C. or below being too low, while steel 26 exhibited a large variation of magnetic flux density through the thickness direction as a result of an excessive reduction ratio at 800° C. or below. A low magnetic flux density and large variation of magnetic flux density through the thickness direction was exhibited by steel 27 because the maximum shape factor was too low, by steel 28 because the dehydrogenation temperature was too low, by steel 29 because the annealing temperature was too low, by steel 30 because the normalizing temperature was too low and by steel 31 because no dehydrogenation was applied.

TABLE 1

| | Chemical composition (wt %) | | | | | | | | | | | | Heating Temp. | Reduction at under 800° C. | Finishing Rolling Temp. |
|---|---|---|---|---|---|---|---|---|---|---|---|---|---|---|---|
| No. | C | Si | Mn | P | S | Cr | Mo | Cu | Al | N | O | H | (°C.) | (%) | (°C.) |
| Invention 1 | 0.007 | 0.01 | 0.15 | 0.010 | 0.003 | 0.04 | 0.007 | 0.01 | 0.030 | 0.003 | 0.004 | 0.00007 | 1050 | 20 | 700 |
| Invention 2 | 0.003 | 0.01 | 0.14 | 0.011 | 0.003 | 0.03 | 0.008 | 0.01 | 0.035 | 0.003 | 0.003 | 0.00007 | 1050 | 20 | 700 |
| Invention 3 | 0.007 | 0.01 | 0.08 | 0.009 | 0.003 | 0.03 | 0.010 | 0.01 | 0.035 | 0.003 | 0.003 | 0.00007 | 1050 | 20 | 700 |
| Invention 4 | 0.006 | 0.01 | 0.01 | 0.012 | 0.002 | 0.04 | 0.008 | 0.01 | 0.025 | 0.003 | 0.003 | 0.00007 | 1050 | 20 | 700 |
| Invention 5 | 0.007 | 0.01 | 0.15 | 0.008 | 0.008 | 0.03 | 0.009 | 0.01 | 0.010 | 0.002 | 0.004 | 0.00006 | 1050 | 20 | 700 |
| Invention 6 | 0.006 | 0.02 | 0.13 | 0.006 | 0.004 | 0.03 | 0.008 | 0.01 | 0.003 | 0.002 | 0.003 | 0.00006 | 1050 | 20 | 700 |
| Invention 7 | 0.008 | 0.02 | 0.14 | 0.005 | 0.008 | 0.04 | 0.007 | 0.01 | 0.030 | 0.002 | 0.004 | 0.00006 | 1100 | 15 | 750 |
| Invention 8 | 0.008 | 0.02 | 0.14 | 0.005 | 0.008 | 0.04 | 0.007 | 0.01 | 0.030 | 0.002 | 0.004 | 0.00006 | 1100 | 15 | 750 |
| Invention 9 | 0.008 | 0.02 | 0.14 | 0.005 | 0.004 | 0.04 | 0.007 | 0.01 | 0.030 | 0.002 | 0.004 | 0.00006 | 1100 | 15 | 750 |
| Invention 10 | 0.006 | 0.01 | 0.17 | 0.007 | 0.003 | 0.02 | 0.009 | 0.01 | 0.032 | 0.003 | 0.003 | 0.00008 | 950 | 25 | 710 |
| Invention 11 | 0.007 | 0.01 | 0.15 | 0.009 | 0.005 | 0.04 | 0.008 | 0.01 | 0.025 | 0.003 | 0.002 | 0.00011 | 950 | 25 | 710 |
| Comparative 12 | 0.020 | 0.01 | 0.16 | 0.012 | 0.004 | 0.05 | 0.009 | 0.01 | 0.030 | 0.003 | 0.003 | 0.00008 | 1100 | 20 | 720 |
| Comparative 13 | 0.006 | 0.04 | 0.14 | 0.010 | 0.003 | 0.03 | 0.006 | 0.01 | 0.039 | 0.003 | 0.002 | 0.00007 | 1100 | 20 | 720 |
| Comparative 14 | 0.007 | 0.01 | 0.30 | 0.012 | 0.002 | 0.04 | 0.008 | 0.01 | 0.038 | 0.002 | 0.002 | 0.00006 | 1150 | 20 | 720 |
| Comparative 15 | 0.006 | 0.01 | 0.14 | 0.010 | 0.015 | 0.03 | 0.006 | 0.01 | 0.035 | 0.002 | 0.003 | 0.00015 | 1150 | 20 | 720 |
| Comparative 16 | 0.007 | 0.01 | 0.15 | 0.010 | 0.003 | 0.10 | 0.005 | 0.01 | 0.036 | 0.002 | 0.002 | 0.00008 | 1150 | 20 | 720 |
| Comparative 17 | 0.006 | 0.01 | 0.13 | 0.012 | 0.003 | 0.04 | 0.050 | 0.01 | 0.035 | 0.003 | 0.002 | 0.00007 | 1050 | 20 | 720 |
| Comparative 18 | 0.007 | 0.02 | 0.13 | 0.013 | 0.002 | 0.04 | 0.007 | 0.03 | 0.020 | 0.003 | 0.002 | 0.00006 | 1050 | 20 | 720 |
| Comparative 19 | 0.009 | 0.01 | 0.15 | 0.013 | 0.003 | 0.04 | 0.006 | 0.01 | 0.060 | 0.003 | 0.003 | 0.00005 | 1050 | 20 | 720 |
| Comparative 20 | 0.008 | 0.01 | 0.16 | 0.014 | 0.002 | 0.03 | 0.005 | 0.01 | 0.030 | 0.006 | 0.003 | 0.00004 | 1050 | 20 | 720 |
| Comparative 21 | 0.008 | 0.01 | 0.13 | 0.015 | 0.006 | 0.02 | 0.009 | 0.01 | 0.029 | 0.002 | 0.010 | 0.00005 | 1050 | 20 | 720 |
| Comparative 22 | 0.007 | 0.01 | 0.12 | 0.014 | 0.006 | 0.02 | 0.009 | 0.01 | 0.025 | 0.002 | 0.003 | 0.00030 | 1050 | 20 | 720 |
| Comparative 23 | 0.008 | 0.01 | 0.16 | 0.010 | 0.002 | 0.02 | 0.008 | 0.01 | 0.025 | 0.002 | 0.002 | 0.00008 | 1200 | 25 | 700 |
| Comparative 24 | 0.008 | 0.01 | 0.15 | 0.011 | 0.003 | 0.02 | 0.009 | 0.01 | 0.024 | 0.002 | 0.002 | 0.00009 | 900 | 25 | 700 |
| Comparative 25 | 0.008 | 0.01 | 0.16 | 0.010 | 0.002 | 0.02 | 0.008 | 0.01 | 0.023 | 0.002 | 0.002 | 0.00007 | 1050 | 0 | 710 |
| Comparative 26 | 0.007 | 0.01 | 0.14 | 0.011 | 0.003 | 0.03 | 0.009 | 0.01 | 0.025 | 0.002 | 0.002 | 0.00008 | 1050 | 50 | 710 |

TABLE 1-continued

| | | | | | | | | | | | | | | | |
|---|---|---|---|---|---|---|---|---|---|---|---|---|---|---|---|
| Comparative 27 | 0.006 | 0.02 | 0.17 | 0.002 | 0.008 | 0.04 | 0.007 | 0.01 | 0.038 | 0.003 | 0.003 | 0.00006 | 1050 | 25 | 710 |
| Comparative 28 | 0.009 | 0.01 | 0.16 | 0.001 | 0.008 | 0.04 | 0.006 | 0.01 | 0.036 | 0.003 | 0.003 | 0.00005 | 1050 | 25 | 710 |
| Comparative 29 | 0.007 | 0.01 | 0.16 | 0.012 | 0.002 | 0.03 | 0.005 | 0.01 | 0.025 | 0.002 | 0.002 | 0.00004 | 1050 | 25 | 710 |
| Comparative 30 | 0.008 | 0.01 | 0.17 | 0.012 | 0.002 | 0.03 | 0.004 | 0.01 | 0.036 | 0.003 | 0.002 | 0.00018 | 1050 | 25 | 710 |
| Comparative 31 | 0.008 | 0.01 | 0.15 | 0.013 | 0.002 | 0.03 | 0.005 | 0.01 | 0.029 | 0.002 | 0.003 | 0.00008 | 1050 | 25 | 720 |

| No. | Shape Ratio | Dehydrogenate Heat treating Temp. (°C.) | Annealing Temp. (°C.) | Normalizing Temp. (°C.) | Thickness (mm) | Cavity Defect Size (μ) | Ferrite Grain No. | Magnetic Flux Density (at 80 A/m) | Variation of Magnetic Flux Density through Thickness Direction (%) |
|---|---|---|---|---|---|---|---|---|---|
| Invention 1 | 0.80 | 700 | — | — | 100 | 20 | 2 | 1.15 | ≦1 |
| Invention 2 | 0.80 | 700 | — | — | 100 | 25 | 2 | 1.45 | ≦1 |
| Invention 3 | 0.80 | 700 | — | — | 100 | 25 | 2 | 1.38 | ≦1 |
| Invention 4 | 0.80 | 700 | — | — | 100 | 20 | 2 | 1.44 | ≦1 |
| Invention 5 | 0.80 | 700 | — | — | 100 | 25 | 2 | 1.35 | ≦1 |
| Invention 6 | 0.80 | 700 | — | — | 100 | 25 | 1 | 1.50 | ≦1 |
| Invention 7 | 0.60 | 720 | — | — | 500 | 90 | 1 | 1.15 | ≦1 |
| Invention 8 | 0.60 | 720 | 850 | — | 500 | 90 | 1 | 1.20 | ≦1 |
| Invention 9 | 0.60 | 720 | — | 930 | 500 | 90 | 1 | 1.17 | ≦1 |
| Invention 10 | 1.10 | — | 850 | — | 40 | 10 | 2 | 1.25 | ≦1 |
| Invention 11 | 1.20 | — | — | 930 | 6 | 5 | 2 | 1.20 | ≦1 |
| Comparative 12 | 0.85 | 680 | — | — | 50 | 50 | 2 | 0.60 | 2 |
| Comparative 13 | 0.85 | 680 | — | — | 50 | 55 | 2 | 0.70 | 4 |
| Comparative 14 | 0.85 | 680 | — | — | 50 | 50 | 2 | 0.90 | 3 |
| Comparative 15 | 0.85 | 680 | — | — | 50 | 45 | 5 | 0.70 | 4 |
| Comparative 16 | 0.85 | 680 | — | — | 50 | 50 | 2 | 0.91 | 3 |
| Comparative 17 | 0.85 | 680 | — | — | 50 | 50 | 2 | 0.88 | 2 |
| Comparative 18 | 0.72 | 680 | — | — | 150 | 65 | 2 | 0.90 | 4 |
| Comparative 19 | 0.72 | 680 | — | — | 150 | 70 | 6 | 0.75 | 3 |
| Comparative 20 | 0.72 | 680 | — | — | 150 | 65 | 5 | 0.80 | 2 |
| Comparative 21 | 0.72 | 680 | — | — | 150 | 70 | 2 | 0.65 | 2 |
| Comparative 22 | 0.72 | 680 | — | — | 150 | 85 | 2 | 0.85 | 4 |
| Comparative 23 | 0.72 | 680 | — | — | 150 | 70 | 7 | 1.10 | 12 |
| Comparative 24 | 0.51 | 680 | — | — | 150 | 200 | 3 | 0.54 | 17 |
| Comparative 25 | 0.72 | 680 | — | — | 150 | 80 | 3 | 0.56 | 4 |
| Comparative 26 | 0.72 | 680 | — | — | 150 | 85 | 3 | 1.01 | 15 |
| Comparative 27 | 0.50 | 680 | — | — | 150 | 150 | 4 | 0.85 | 10 |
| Comparative 28 | 0.72 | 550 | — | — | 150 | 70 | 2 | 0.80 | 12 |
| Comparative 29 | 1.10 | — | 700 | — | 10 | 10 | 2 | 0.80 | 14 |
| Comparative 30 | 1.10 | — | — | 1050 | 10 | 10 | 2 | 0.85 | 9 |
| Comparative 31 | 0.80 | — | 850 | — | 100 | 50 | 2 | 0.85 | 15 |

No. 6 is contained 0.005% Ca.

EXAMPLE 2

Table 2 lists the production conditions, ferrite grain size, magnetic flux density in a low magnetic field and variation of the magnetic flux density through the thickness direction of high-silicon electrical steel plate. Steels 32 to 43 are inventive steels and steels 44 and 45 are comparative steels.

Steels 32 to 36, which were finished to a thickness of 100 mm, exhibited high magnetic flux density and low variation through the thickness direction and also had high specific resistance. Compared with steel 32, steel 33, with lower carbon, steels 34 and 35, with lower manganese, steel 36, with lower aluminum, steel 37, with added calcium and no added aluminum, steel 38, with silicon as the deoxidizing agent and no added aluminum or calcium, showed better magnetic properties. Steels 39 to 41, which were finished to a thickness of 500 mm, steel 42, which was finished to a thickness of 40 mm, and steel 43, which was finished to a thickness of 6 mm, each exhibited high magnetic flux density with low variation through the thickness direction together with a high specific resistance. Low silicon in steel 44 resulted in a low specific resistance, while excessive silicon resulted in poor magnetic properties in steel 45.

TABLE 2

| | Chemical composition (wt %) | | | | | | | | | | | | Heating Temp. | Reduction at under 800° C. | Finishing Rolling Temp. |
|---|---|---|---|---|---|---|---|---|---|---|---|---|---|---|---|
| No. | C | Si | Mn | P | S | Cr | Mo | Cu | Al | N | O | H | (°C.) | (%) | (°C.) |
| Invention 32 | 0.006 | 0.2 | 0.14 | 0.009 | 0.004 | 0.03 | 0.006 | 0.01 | 0.031 | 0.003 | 0.004 | 0.00006 | 1050 | 20 | 700 |
| Invention 33 | 0.002 | 0.2 | 0.15 | 0.010 | 0.002 | 0.02 | 0.007 | 0.01 | 0.036 | 0.003 | 0.003 | 0.00006 | 1050 | 20 | 700 |
| Invention 34 | 0.006 | 0.2 | 0.07 | 0.008 | 0.004 | 0.03 | 0.009 | 0.01 | 0.036 | 0.003 | 0.003 | 0.00006 | 1050 | 20 | 700 |
| Invention 35 | 0.007 | 0.5 | 0.01 | 0.011 | 0.001 | 0.03 | 0.007 | 0.01 | 0.026 | 0.003 | 0.003 | 0.00006 | 1050 | 20 | 700 |
| Invention 36 | 0.006 | 0.5 | 0.14 | 0.007 | 0.007 | 0.03 | 0.008 | 0.01 | 0.010 | 0.002 | 0.004 | 0.00005 | 1050 | 20 | 700 |
| Invention 37 | 0.007 | 0.5 | 0.12 | 0.006 | 0.005 | 0.02 | 0.007 | 0.01 | 0.003 | 0.002 | 0.004 | 0.00006 | 1050 | 20 | 700 |
| Invention 38 | 0.006 | 0.5 | 0.13 | 0.008 | 0.006 | 0.02 | 0.007 | 0.01 | 0.002 | 0.002 | 0.003 | 0.00007 | 1050 | 20 | 700 |
| Invention 39 | 0.007 | 1.5 | 0.13 | 0.004 | 0.007 | 0.03 | 0.006 | 0.01 | 0.031 | 0.002 | 0.004 | 0.00005 | 1100 | 15 | 750 |
| Invention 40 | 0.007 | 1.5 | 0.13 | 0.004 | 0.007 | 0.03 | 0.006 | 0.01 | 0.031 | 0.002 | 0.004 | 0.00005 | 1100 | 15 | 750 |
| Invention 41 | 0.008 | 1.5 | 0.13 | 0.006 | 0.003 | 0.03 | 0.006 | 0.01 | 0.031 | 0.002 | 0.004 | 0.00005 | 1100 | 15 | 750 |
| Invention 42 | 0.006 | 3.0 | 0.16 | 0.006 | 0.002 | 0.02 | 0.008 | 0.01 | 0.033 | 0.003 | 0.003 | 0.00007 | 950 | 25 | 710 |
| Invention 43 | 0.008 | 3.0 | 0.16 | 0.008 | 0.004 | 0.03 | 0.007 | 0.01 | 0.026 | 0.003 | 0.002 | 0.00010 | 950 | 25 | 710 |
| Comparative 44 | 0.007 | 0.05 | 0.13 | 0.011 | 0.002 | 0.03 | 0.005 | 0.01 | 0.038 | 0.003 | 0.002 | 0.00006 | 1100 | 20 | 720 |
| Comparative 45 | 0.006 | 4.5 | 0.14 | 0.011 | 0.002 | 0.03 | 0.006 | 0.01 | 0.038 | 0.002 | 0.002 | 0.00008 | 1100 | 20 | 720 |

| | Dehydrogen- | Anneal- | Normal- | Cavity | Magnetic Flux | Variation of Mag- |
|---|---|---|---|---|---|---|

TABLE 2-continued

| No. | Shape Ratio | ate Heat treating Temp. (°C.) | ing Temp. (°C.) | izing Temp. (°C.) | Thick-ness (mm) | Defect Size (μ) | Ferrite Grain No. | Density (at 80 A/m) | netic Flux Density through Thickness Direction (%) | Natural Resistance (μΩ · cm) |
|---|---|---|---|---|---|---|---|---|---|---|
| Invention 32 | 0.90 | 700 | — | — | 100 | 20 | 2 | 1.20 | ≦1 | 35 |
| Invention 33 | 0.90 | 700 | — | — | 100 | 25 | 2 | 1.46 | ≦1 | 34 |
| Invention 34 | 0.90 | 700 | — | — | 100 | 25 | 2 | 1.41 | ≦1 | 36 |
| Invention 35 | 0.90 | 700 | — | — | 100 | 20 | 2 | 1.44 | ≦1 | 36 |
| Invention 36 | 0.90 | 700 | — | — | 100 | 25 | 2 | 1.37 | ≦1 | 37 |
| Invention 37 | 0.90 | 700 | — | — | 100 | 20 | 2 | 1.48 | ≦1 | 38 |
| Invention 38 | 0.90 | 700 | — | — | 100 | 25 | 2 | 1.52 | ≦1 | 37 |
| Invention 39 | 0.60 | 720 | — | — | 500 | 90 | 1 | 1.20 | ≦1 | 38 |
| Invention 40 | 0.60 | 720 | 850 | — | 500 | 90 | 1 | 1.25 | ≦1 | 37 |
| Invention 41 | 0.60 | 720 | — | 930 | 500 | 90 | 1 | 1.21 | ≦1 | 38 |
| Invention 42 | 1.10 | — | 850 | — | 40 | 10 | 2 | 1.30 | ≦1 | 42 |
| Invention 43 | 1.20 | — | — | 930 | 6 | 5 | 2 | 1.25 | ≦1 | 41 |
| Comparative 44 | 0.85 | 680 | — | — | 50 | 55 | 2 | 1.10 | 4 | 28 |
| Comparative 45 | 0.85 | 680 | — | — | 50 | 55 | 2 | 0.61 | 4 | 49 |

No. 37 is contained 0.008% Ca.

EXAMPLE 3

Table 3 lists the production conditions, ferrite grain size, magnetic flux density in a low magnetic field and variation of the magnetic flux density through the thickness direction of electrical steel plate with added nickel.

TABLE 3

| No. | Chemical composition (wt %) C | Si | Mn | P | S | Cr | Mo | Cu | Ni | Al | N | O | H | Heating Temp. (°C.) | Reduction at under 800° C. (%) | Finishing Rolling Temp. (°C.) |
|---|---|---|---|---|---|---|---|---|---|---|---|---|---|---|---|---|
| Invention 46 | 0.007 | 0.01 | 0.15 | 0.010 | 0.003 | 0.04 | 0.007 | 0.01 | 1.0 | 0.032 | 0.003 | 0.004 | 0.00006 | 1050 | 20 | 700 |
| Invention 47 | 0.002 | 0.01 | 0.15 | 0.009 | 0.003 | 0.03 | 0.006 | 0.01 | 1.0 | 0.035 | 0.003 | 0.003 | 0.00007 | 1050 | 20 | 700 |
| Invention 48 | 0.007 | 0.02 | 0.06 | 0.008 | 0.004 | 0.02 | 0.008 | 0.01 | 1.0 | 0.033 | 0.003 | 0.003 | 0.00007 | 1050 | 20 | 700 |
| Invention 49 | 0.006 | 0.01 | 0.01 | 0.010 | 0.001 | 0.03 | 0.006 | 0.01 | 1.0 | 0.025 | 0.003 | 0.003 | 0.00005 | 1050 | 20 | 700 |
| Invention 50 | 0.006 | 0.02 | 0.15 | 0.008 | 0.006 | 0.04 | 0.007 | 0.01 | 1.0 | 0.009 | 0.002 | 0.004 | 0.00006 | 1050 | 20 | 700 |
| Invention 51 | 0.007 | 0.01 | 0.14 | 0.008 | 0.005 | 0.02 | 0.007 | 0.01 | 1.0 | 0.002 | 0.002 | 0.003 | 0.00007 | 1050 | 20 | 700 |
| Invention 52 | 0.006 | 0.01 | 0.14 | 0.003 | 0.006 | 0.03 | 0.007 | 0.01 | 1.5 | 0.034 | 0.002 | 0.004 | 0.00006 | 1100 | 15 | 750 |
| Invention 53 | 0.006 | 0.01 | 0.13 | 0.004 | 0.006 | 0.02 | 0.006 | 0.01 | 1.5 | 0.034 | 0.002 | 0.004 | 0.00006 | 1100 | 15 | 750 |
| Invention 54 | 0.007 | 0.02 | 0.14 | 0.005 | 0.002 | 0.03 | 0.007 | 0.01 | 1.5 | 0.032 | 0.002 | 0.004 | 0.00006 | 1100 | 15 | 750 |
| Invention 55 | 0.007 | 0.01 | 0.15 | 0.006 | 0.002 | 0.02 | 0.009 | 0.01 | 0.5 | 0.031 | 0.003 | 0.003 | 0.00006 | 950 | 25 | 710 |
| Invention 56 | 0.007 | 0.02 | 0.15 | 0.009 | 0.003 | 0.03 | 0.006 | 0.01 | 0.5 | 0.027 | 0.003 | 0.002 | 0.00009 | 950 | 25 | 710 |
| Comparative 57 | 0.007 | 0.01 | 0.14 | 0.012 | 0.003 | 0.03 | 0.008 | 0.01 | 0.05 | 0.025 | 0.003 | 0.002 | 0.00007 | 1050 | 20 | 720 |
| Comparative 58 | 0.006 | 0.01 | 0.14 | 0.013 | 0.004 | 0.03 | 0.009 | 0.01 | 2.5 | 0.029 | 0.002 | 0.002 | 0.00008 | 1050 | 20 | 720 |

| No. | Shape Ratio | Dehydrogenate Heat treating Temp. (°C.) | Annealing Temp. (°C.) | Normalizing Temp. (°C.) | Thickness (mm) | Cavity Defect Size (μ) | Ferrite Grain No. | Magnetic Flux Density (at 80 A/m) | Variation of Magnetic Flux Density through Thickness Direction (%) | Coercive Force (A/m) |
|---|---|---|---|---|---|---|---|---|---|---|
| Invention 46 | 0.90 | 700 | — | — | 100 | 20 | 2 | 1.20 | ≦1 | 52 |
| Invention 47 | 0.90 | 700 | — | — | 100 | 25 | 2 | 1.46 | ≦1 | 51 |
| Invention 48 | 0.90 | 700 | — | — | 100 | 25 | 2 | 1.41 | ≦1 | 52 |
| Invention 49 | 0.90 | 700 | — | — | 100 | 20 | 2 | 1.44 | ≦1 | 51 |
| Invention 50 | 0.90 | 700 | — | — | 100 | 25 | 2 | 1.37 | ≦1 | 51 |
| Invention 51 | 0.90 | 700 | — | — | 100 | 25 | 2 | 1.51 | ≦1 | 52 |
| Invention 52 | 0.60 | 720 | — | — | 500 | 90 | 1 | 1.20 | ≦1 | 53 |
| Invention 53 | 0.60 | 720 | 850 | — | 500 | 90 | 1 | 1.25 | ≦1 | 54 |
| Invention 54 | 0.60 | 720 | — | 930 | 500 | 90 | 1 | 1.21 | ≦1 | 53 |
| Invention 55 | 1.10 | — | 850 | — | 40 | 10 | 2 | 1.30 | ≦1 | 54 |
| Invention 56 | 1.20 | — | — | 930 | 6 | 5 | 2 | 1.25 | ≦1 | 54 |
| Comparative 57 | 0.85 | 680 | — | — | 150 | 70 | 2 | 1.10 | 3 | 65 |
| Comparative 58 | 0.85 | 680 | — | — | 150 | 65 | 2 | 0.85 | 3 | 69 |

No. 51 is contained 0.005% Ca.

Steels 46 to 56 are inventive steels and steels 57 and 58 are comparative steels.

Steels 46 to 51, which were finished to a thickness of 100 mm, exhibited high magnetic flux density and low variation through the thickness direction and also showed low coercivity. Compared with steel 46, steel 47, with lower carbon, steels 48 and 49, with lower manganese, steel 50, with lower aluminum, steel 51, with added calcium and no added aluminum, each showed better magnetic properties. Steels 52 to 54, which were finished to a thickness of 500 mm, steel 55, which was finished to a thickness of 40 mm, and steel 56, which was finished to a thickness of 6 mm, each exhibited high magnetic flux density with low variation through the thickness direction together with a low coercivity. Low nickel in steel 57 resulted in high coercivity, while excessive nickel in steel 58 resulted in low magnetic flux density and high coercivity.

EXAMPLE 4

Table 4 lists the production conditions, ferrite grain size, magnetic flux density in a low magnetic field and variation of the magnetic flux density through the thickness direction of electrical steel plate with added titanium. Steels 59 to 69 are inventive steels and steels 70 and 71 are comparative steels.

Steels 59 to 64, which were finished to a thickness of 100mm, exhibited high magnetic flux density and low variation through the thickness direction and also had high tensile strength. Compared with steel 59, steel 60, with lower carbon, steels 61 and 62, with lower manganese, steel 63, with lower aluminum, steel 64, with added calcium and no added aluminum, each showed better magnetic properties, Steels 65 to 67, which were finished to a thickness of 500mm, steel 68, which was finished to a thickness of 40mm, and steel 69, which was finished to a thickness of 6mm, each exhibited high magnetic flux density with low variation through the thickness direction together with a high tensile strength.

Low titanium in steel 70 resulted in low tensile strength, while excessive titanium in steel 71 resulted in poor magnetic properties.

ness direction of electrical steel plate with added phosphorus. Steels 72 to 77 are inventive steels and steels 78 to 80 are comparative steels.

Steels 72 to 74, which were finished to a thickness of 100 mm, exhibited high magnetic flux density and low variation through the thickness direction and also had good machinability. Compared with steel 72, steel 73, with lower carbon, and steel 74, with lower manganese, each showed better magnetic properties. Steel 75, which was finished to a thickness of 40 mm, steel 76, which was finished to a thickness of 6 mm, and steel 77, which was finished to a thickness of 10 mm, each exhibited high magnetic flux density with low variation through the thickness direction together with good machinability.

Low phosphorus in steel 78 and 79 resulted in poor machinability, while excessive phosphorus in steel 80 resulted in poor magnetic properties.

TABLE 4

| No. | Chemical composition (wt %) C | Si | Mn | P | S | Cr | Mo | Cu | Ti | Al | N | O | H | Heating Temp. (°C.) | Reduction at under 800° C. (%) | Finishing Rolling Temp. (°C.) |
|---|---|---|---|---|---|---|---|---|---|---|---|---|---|---|---|---|
| Invention 59 | 0.006 | 0.01 | 0.16 | 0.011 | 0.004 | 0.04 | 0.008 | 0.01 | 0.05 | 0.034 | 0.002 | 0.003 | 0.00008 | 1050 | 20 | 700 |
| Invention 60 | 0.002 | 0.02 | 0.16 | 0.007 | 0.004 | 0.04 | 0.007 | 0.01 | 0.05 | 0.031 | 0.002 | 0.004 | 0.00009 | 1050 | 20 | 700 |
| Invention 61 | 0.006 | 0.01 | 0.07 | 0.007 | 0.005 | 0.03 | 0.007 | 0.01 | 0.05 | 0.035 | 0.002 | 0.004 | 0.00009 | 1050 | 20 | 700 |
| Invention 62 | 0.008 | 0.02 | 0.01 | 0.023 | 0.001 | 0.02 | 0.005 | 0.01 | 0.05 | 0.027 | 0.002 | 0.004 | 0.00007 | 1050 | 20 | 700 |
| Invention 63 | 0.007 | 0.01 | 0.16 | 0.009 | 0.007 | 0.03 | 0.006 | 0.01 | 0.10 | 0.008 | 0.003 | 0.003 | 0.00008 | 1050 | 20 | 700 |
| Invention 64 | 0.008 | 0.01 | 0.15 | 0.010 | 0.004 | 0.01 | 0.006 | 0.01 | 0.10 | 0.002 | 0.003 | 0.004 | 0.00009 | 1050 | 20 | 700 |
| Invention 65 | 0.007 | 0.02 | 0.15 | 0.003 | 0.005 | 0.02 | 0.006 | 0.01 | 0.10 | 0.036 | 0.003 | 0.003 | 0.00008 | 1100 | 15 | 750 |
| Invention 66 | 0.006 | 0.01 | 0.14 | 0.005 | 0.005 | 0.01 | 0.005 | 0.01 | 0.10 | 0.036 | 0.003 | 0.003 | 0.00008 | 1100 | 15 | 750 |
| Invention 67 | 0.008 | 0.02 | 0.15 | 0.007 | 0.003 | 0.02 | 0.006 | 0.01 | 0.20 | 0.034 | 0.003 | 0.003 | 0.00008 | 1100 | 15 | 750 |
| Invention 68 | 0.008 | 0.01 | 0.16 | 0.008 | 0.003 | 0.01 | 0.008 | 0.01 | 0.20 | 0.033 | 0.002 | 0.004 | 0.00008 | 950 | 25 | 710 |
| Invention 69 | 0.007 | 0.01 | 0.13 | 0.014 | 0.004 | 0.02 | 0.005 | 0.01 | 0.20 | 0.029 | 0.002 | 0.003 | 0.00011 | 950 | 25 | 710 |
| Comparative 70 | 0.006 | 0.01 | 0.15 | 0.011 | 0.004 | 0.04 | 0.009 | 0.01 | 0.03 | 0.027 | 0.002 | 0.003 | 0.00008 | 1050 | 20 | 720 |
| Comparative 71 | 0.007 | 0.02 | 0.15 | 0.014 | 0.005 | 0.04 | 0.009 | 0.01 | 0.25 | 0.027 | 0.003 | 0.003 | 0.00009 | 1050 | 20 | 720 |

| No. | Shape Ratio | Dehydrogenate Heat treating Temp. (°C.) | Annealing Temp. (°C.) | Normalizing Temp. (°C.) | Thickness (mm) | Cavity Defect Size (μ) | Ferrite Grain No. | Magnetic Flux Density (at 80 A/m) | Variation of Magnetic Flux Density through Thickness Direction (%) | Tensile Strength (kgf/mm²) |
|---|---|---|---|---|---|---|---|---|---|---|
| Invention 59 | 0.90 | 700 | — | — | 100 | 25 | 1 | 1.10 | ≦1 | 41.5 |
| Invention 60 | 0.90 | 700 | — | — | 100 | 20 | 1 | 1.36 | ≦1 | 42.2 |
| Invention 61 | 0.90 | 700 | — | — | 100 | 20 | 1 | 1.31 | ≦1 | 41.3 |
| Invention 62 | 0.90 | 700 | — | — | 100 | 25 | 1 | 1.34 | ≦1 | 42.4 |
| Invention 63 | 0.90 | 700 | — | — | 100 | 20 | 1 | 1.27 | ≦1 | 48.5 |
| Invention 64 | 0.90 | 700 | — | — | 100 | 20 | 2 | 1.41 | ≦1 | 49.3 |
| Invention 65 | 0.60 | 720 | — | — | 500 | 95 | 1 | 1.10 | ≦1 | 48.8 |
| Invention 66 | 0.60 | 720 | 850 | — | 500 | 95 | 2 | 1.15 | ≦1 | 49.2 |
| Invention 67 | 0.60 | 720 | — | 930 | 500 | 85 | 1 | 1.11 | ≦1 | 60.1 |
| Invention 68 | 1.10 | — | 850 | — | 40 | 15 | 1 | 1.20 | ≦1 | 59.8 |
| Invention 69 | 1.20 | — | — | 930 | 6 | 5 | 1 | 1.15 | ≦1 | 60.3 |
| Comparative 70 | 0.85 | 680 | — | — | 150 | 75 | 2 | 1.04 | 3 | 38.1 |
| Comparative 71 | 0.85 | 680 | — | — | 150 | 60 | 1 | 0.75 | 3 | 61.6 |

No. 64 is contained 0.005% Ca.

EXAMPLE 5

Table 5 lists the production conditions, ferrite grain size, magnetic flux density in a low magnetic field and variation of the magnetic flux density through the thick-

TABLE 5

| No. | Chemical composition (wt %) C | Si | Mn | P | S | Cr | Mo | Cu | Al | N | O | H | Heating Temp. (°C.) | Reduction at under 800° C. (%) | Finishing Rolling Temp. (°C.) |
|---|---|---|---|---|---|---|---|---|---|---|---|---|---|---|---|
| Invention 72 | 0.006 | 0.01 | 0.15 | 0.030 | 0.003 | 0.04 | 0.007 | 0.01 | 0.032 | 0.003 | 0.004 | 0.00006 | 1050 | 20 | 700 |
| Invention 73 | 0.002 | 0.01 | 0.15 | 0.100 | 0.003 | 0.03 | 0.006 | 0.01 | 0.035 | 0.003 | 0.003 | 0.00007 | 1050 | 20 | 700 |
| Invention 74 | 0.006 | 0.02 | 0.06 | 0.150 | 0.004 | 0.02 | 0.008 | 0.01 | 0.033 | 0.003 | 0.003 | 0.00007 | 1050 | 20 | 700 |
| Invention 75 | 0.008 | 0.01 | 0.15 | 0.060 | 0.002 | 0.02 | 0.009 | 0.01 | 0.031 | 0.003 | 0.003 | 0.00006 | 950 | 25 | 710 |
| Invention 76 | 0.007 | 0.02 | 0.15 | 0.120 | 0.003 | 0.03 | 0.006 | 0.01 | 0.027 | 0.003 | 0.002 | 0.00009 | 950 | 25 | 710 |
| Invention 77 | 0.006 | 0.01 | 0.10 | 0.120 | 0.002 | 0.02 | 0.006 | 0.01 | 0.002 | 0.002 | 0.002 | 0.00008 | 950 | 20 | 720 |
| Comparative 78 | 0.008 | 0.01 | 0.01 | 0.015 | 0.001 | 0.03 | 0.006 | 0.01 | 0.025 | 0.003 | 0.003 | 0.00005 | 1050 | 20 | 700 |
| Comparative 79 | 0.007 | 0.02 | 0.15 | 0.008 | 0.006 | 0.04 | 0.007 | 0.01 | 0.009 | 0.002 | 0.004 | 0.00006 | 1050 | 20 | 700 |
| Comparative 80 | 0.008 | 0.01 | 0.14 | 0.300 | 0.005 | 0.02 | 0.007 | 0.01 | 0.002 | 0.002 | 0.003 | 0.00007 | 1050 | 20 | 700 |

| | Shape | Dehydrogenate Heat treating | Annealing Temp. | Normalizing Temp. | Thickness | Cavity Defect Size | Ferrite Grain | Magnetic Flux Density | Variation of Magnetic Flux Density through Thick- | Machin- |
|---|---|---|---|---|---|---|---|---|---|---|

TABLE 5-continued

| No. | Ratio | Temp. (°C.) | (°C.) | (°C.) | (mm) | (μ) | No. | (at 80 A/m) | ness Direction (%) | ability |
|---|---|---|---|---|---|---|---|---|---|---|
| Invention 72 | 0.90 | 700 | — | — | 100 | 20 | 2 | 1.10 | ≦1 | ○ |
| Invention 73 | 0.90 | 700 | — | — | 100 | 25 | 2 | 1.33 | ≦1 | ○ |
| Invention 74 | 0.90 | 700 | — | — | 100 | 25 | 2 | 1.29 | ≦1 | ○ |
| Invention 75 | 1.10 | — | 850 | — | 40 | 10 | 2 | 1.20 | ≦1 | ○ |
| Invention 76 | 1.20 | — | — | 930 | 6 | 5 | 2 | 1.12 | ≦1 | ○ |
| Invention 77 | 1.00 | — | — | 930 | 10 | 5 | 1 | 1.38 | ≦1 | ○ |
| Comparative 78 | 0.90 | 700 | — | — | 100 | 20 | 2 | 1.34 | ≦1 | Δ |
| Comparative 79 | 0.90 | 700 | — | — | 100 | 25 | 2 | 1.27 | ≦1 | Δ |
| Comparative 80 | 0.90 | 700 | — | — | 100 | 25 | 2 | 0.90 | ≦1 | ○ |

No. 77 is contained 0.006% Ca.

We claim:

1. A method of producing high strength non-oriented electrical steel plate having high magnetic flux density and uniform magnetic properties through the thickness direction comprising the steps of:

preparing a steel slab comprising, by weight, up to 0.01 percent carbon, up to 0.20 percent manganese, up to 0.20 percent phosphorus, up to 0.010 percent sulfur, up to 0.05 percent chromium, up to 0.01 percent molybdenum, up to 0.01 percent copper, up to 2.0 percent nickel, up to 0.20 percent titanium, up to 0.004 percent nitrogen, up to 0.005 percent oxygen and up to 0.002 percent hydrogen, and one or more deoxidizing agents selected from a group consisting of up to 4.0 percent silicon, 0.005 to 0.40 percent aluminum, and 0.05 to 0.01 percent calcium, with the remainder being substantially iron;

heating the slab to a temperature of 950° to 1150° C;

carrying out at least one hot-rolling at a rolling shape factor A of at least 0.6 at a finish rolling temperature of at least 800° C;

following this by hot rolling at a temperature of up to 800° C. and a reduction ratio of 10 to 35 percent to obtain a steel sheet plate with a gauge thickness of at least 50mm;

applying dehydrogenation heat treatment at between 600° and 750° C. to said steel plate;

wherein the hot rolling is accomplished using a rolling mill having a radius R (mm) and wherein the steel plate has an entry-side thickness $h_1$(mm) and an exit-side plate thickness $h_0$(mm) which exhibits a relationship with rolling shape factor A or the hot rolling as follows:

$$A = (2\sqrt{R(h_1 - h_0)})/(h_1 + h_0).$$

2. The method according to claim 1 that includes the step of preparing a steel slab comprising, by weight, to 0.01 percent carbon, up to 0.02 percent silicon, up to 0.20 percent manganese, up to 0.010 percent sulfur, up to 0.05 percent chromium, up to 0.01 percent molybdenum, up to 0.01 percent copper, up to 0.04 percent nitrogen, up to 0.005 percent oxygen and up to 0.0002 percent hydrogen and a deoxidizing agent selected from 0.005 to 0.40 percent aluminum and 0.005 to 0.01 percent calcium, with the remainder being substantially iron.

3. The method according to claim 2 in which the deoxidizing agent of the steel is 0.1 to 4.0 percent silicon and from 0.005 to 0.40 percent aluminum or from 0.0005 to 0.01 percent calcium.

4. The method according to claim 2 in which the composition of the steel includes 0.1 to 2.0 percent nickel.

5. The method according to claim 2 in which the composition of the steel include 0.04 to 0.20 percent titanium.

6. The method according to claim 2 in which the composition of the steel includes 0.02 to 0.20 percent phosphorus.

7. The method according to claim 1 further comprising the step of annealing at a temperature of 750° to 950° C. following said dehydrogenation heat treatment.

8. The method according to claim 1 further comprising the step or normalizing at a temperature of 910° to 1000° C. following the dehydrogenation heat treatment.

9. A method of producing high strength non-oriented electrical steel plate having high magnetic flux density and uniform magnetic properties through the thickness direction comprising the steps of:

preparing a steel slab comprising, by weight, up to 0.01 percent carbon, up to 0.20 percent manganese, up to 0.20 percent phosphorus, up to 0.010 percent sulfur, up to 0.05 percent chromium, up to 0.01 percent molybdenum, up to 0.01 percent copper, up to 2.0 percent nickel, up to 0.20 percent titanium, up to 0.004 percent nitrogen, up to 0.005 percent oxygen and up to 0.0002 percent hydrogen, and one or more deoxidizing agents selected from a group consisting of up to 4.0 percent silicon, 0.005 to 0.40 percent aluminum, and 0.0005 to 0.01 percent calcium, with the remainder being substantially iron;

heating the slab to a temperature of 950° to 1150° C;

carrying out at least one hot-rolling at a rolling shape factor A of at least 0.6 at a finish rolling temperature of at least 800° C;

following this by hot rolling at a temperature of up to 800° C and a reduction ratio of 10 to 35 percent to obtain a steel plate with a gauge thickness of less than 50mm;

annealing said steel plate at a temperature of 750° to 950° C;

wherein the hot rolling is accomplished using a rolling mill having a radius R (mm) and wherein the steel plate has an entry-side thickness $h_1$ (mm) and an exit-side plate thickness $h_0$ (mm) which exhibits a relationship with rolling shape factor A of the hot rolling as follows:

$$A = (2\sqrt{R(h_1 - h_0)})/(h_1 + h_0).$$

10. The method according to claim 9 wherein said steel plate is normalized at a temperature of 910° C. to 1000° C.

11. The method according to claim 9 that includes the step of preparing a steel slab comprising, by weight, up to 0.01 percent carbon, up to 0.02 percent silicon, up to 0.20 percent manganese, up to 0.010 percent sulfur, up to 0.05 percent chromium, up to 0.01 percent molybdenum, up to 0.01 percent copper, up to 0.004 percent nitrogen, up to 0.005 percent oxygen and up to 0.0002 percent hydrogen and a deoxidizing agent selected from 0.005 to 0.40 percent aluminum and 0.0005 to 0.01 percent calcium, with the remainder being substantially iron.

12. The method according to claim 11 in which the deoxidizing agent of the steel is 0.1 to 4.0 percent silicon and from 0.005 to 0.40 percent aluminum or from 0.005 to 0.01 percent calcium.

13. The method according to claim 11 in which the composition of the steel includes 0.1 to 0.2 percent nickel.

14. The method according to claim 11 in which the composition of the steel includes 0.04 to 0.20 percent titanium.

15. The method according to claim 11 in which the composition of the steel includes 0.02 to 0.20 percent phosphorus.

* * * * *

UNITED STATES PATENT AND TRADEMARK OFFICE

CERTIFICATE OF CORRECTION

PATENT NO. : 5,037,493

DATED : August 6, 1991

INVENTOR(S) : Yukio Tomita, et al.

It is certified that error appears in the above-identified patent and that said Letters Patent is hereby corrected as shown below:

Col. 3, line 21, change "10%-" to --10-35%--.
Col. 9, bottom of Table 2, add --No. 37 is contained 0.008% Ca.--.
Col. 11, bottom of Table 2, delete "No. 37 is contained 0.008% Ca.".
Col. 11, bottom of Table 3 (first part), add --No. 51 is contained 0.005% Ca.--.
Col. 11, bottom of Table 3 (second part),delete "No. 51 is contained 0.005% Ca.".
Col. 11, line 66, change "54," to --54, which were finished to a thickness of 500mm, steel 55, which was finished to a thickness of 40mm, and steel--.
Col. 13, line 1, change "high" to --100mm, exhibited high magnetic flux density and low variation through the thickness direction and also had high--.
Col. 13, bottom of Table 4 (first part), add --No. 64 is contained 0.005% Ca.--.
Col. 13, bottom of Table 4 (second part), delete "No.64 is contained 0.005% Ca.".
Col. 13, bottom of Table 5, add --No. 77 is contained 0.006% Ca.--.
Col. 15, bottom of Table 5, delete "No. 77 is contained 0.006% Ca.".
Col. 16, Table 5, (last column) "O" to --0--.

Col. 15, line 28, change "0.002" to --0.0002--.
Col. 15, line 31, change "0.05" to --0.005--.

UNITED STATES PATENT AND TRADEMARK OFFICE

CERTIFICATE OF CORRECTION

PATENT NO. : 5,037,493

DATED : August 6, 1991

INVENTOR(S) : Yukio Tomita, et al.

It is certified that error appears in the above-identified patent and that said Letters Patent is hereby corrected as shown below:

Col. 15, line 59, change "0.04" to --0.004--.
Col. 15, line 62, change "0.005" to --0.0005--.
Col. 16, line 18, change "include" to --includes--.
Col. 16, line 27, change "or" to --of--.

Signed and Sealed this

Twenty-seventh Day of April, 1993

*Attest:*

MICHAEL K. KIRK

*Attesting Officer*

*Acting Commissioner of Patents and Trademarks*